US005261361A

United States Patent [19]

Speil

[11] Patent Number: 5,261,361

[45] Date of Patent: Nov. 16, 1993

[54] ASSEMBLY FOR SIMULTANEOUSLY ACTUATING TWO VALVES OF AN INTERNAL COMBUSTION ENGINE

[75] Inventor: Walter Speil, Ingolstadt, Fed. Rep. of Germany

[73] Assignee: Ina Walzlager Schaeffler KG, Fed. Rep. of Germany

[21] Appl. No.: 976,973

[22] PCT Filed: Nov. 27, 1991

[86] PCT No.: PCT/EP91/02245

§ 371 Date: Jan. 19, 1993

§ 102(e) Date: Jan. 19, 1993

[87] PCT Pub. No.: WO92/10650

PCT Pub. Date: Jun. 25, 1992

[30] Foreign Application Priority Data

Dec. 8, 1990 [DE] Fed. Rep. of Germany ..... 4039256

[51] Int. Cl.[5] ..... F01L 1/26

[52] U.S. Cl. ..... 123/90.22; 123/90.5; 123/90.55

[58] Field of Search ..... 123/90.22, 90.48, 90.49, 123/90.5, 90.52, 90.55

[56] References Cited

U.S. PATENT DOCUMENTS

| | | | |
|---|---|---|---|
| 4,677,723 | 7/1987 | Greene, Sr. | 123/90.22 |
| 4,773,359 | 9/1988 | Titolo | 123/90.22 |
| 4,805,567 | 2/1989 | Heimburg | 123/90.22 |
| 4,924,821 | 5/1990 | Teerman | 123/90.22 |
| 5,150,672 | 9/1992 | Fischer et al. | 123/90.22 |

FOREIGN PATENT DOCUMENTS

| | | | |
|---|---|---|---|
| 2941495 | 5/1980 | Fed. Rep. of Germany . | |
| 484035 | 8/1917 | France . | |
| 495639 | 10/1919 | France . | |
| 555853 | 7/1923 | France . | |
| 2553823 | 4/1985 | France | 123/90.22 |
| 465540 | 5/1937 | United Kingdom | 123/90.22 |

*Primary Examiner*—E. Rollins Cross
*Assistant Examiner*—Weilun Lo
*Attorney, Agent, or Firm*—Bierman and Muserlian

[57] ABSTRACT

In an assembly for simultaneously actuating two valves (2) of an internal combustion engine, comprising a beam-shaped bridge (6) in end regions whereof hydraulic lash adjusters (5) are lodged which engage stem ends of valves (2), the bridge (6) being guided parallel to longitudinal axes of the valves (2) in the cylinder heade (1), and valve actuating components engaging a central region of the bridge (6) between the two lash adjusters (5), a less complicated structure as compared to known constructions and thus also less design space requirement with, at the same time, reduced friction, are obtained by the fact that a rotatably mounted roller (8) adapted to be engaged directly by a control cam (10) is arranged at the center of the bridge (6).

9 Claims, 8 Drawing Sheets

Figure 1:
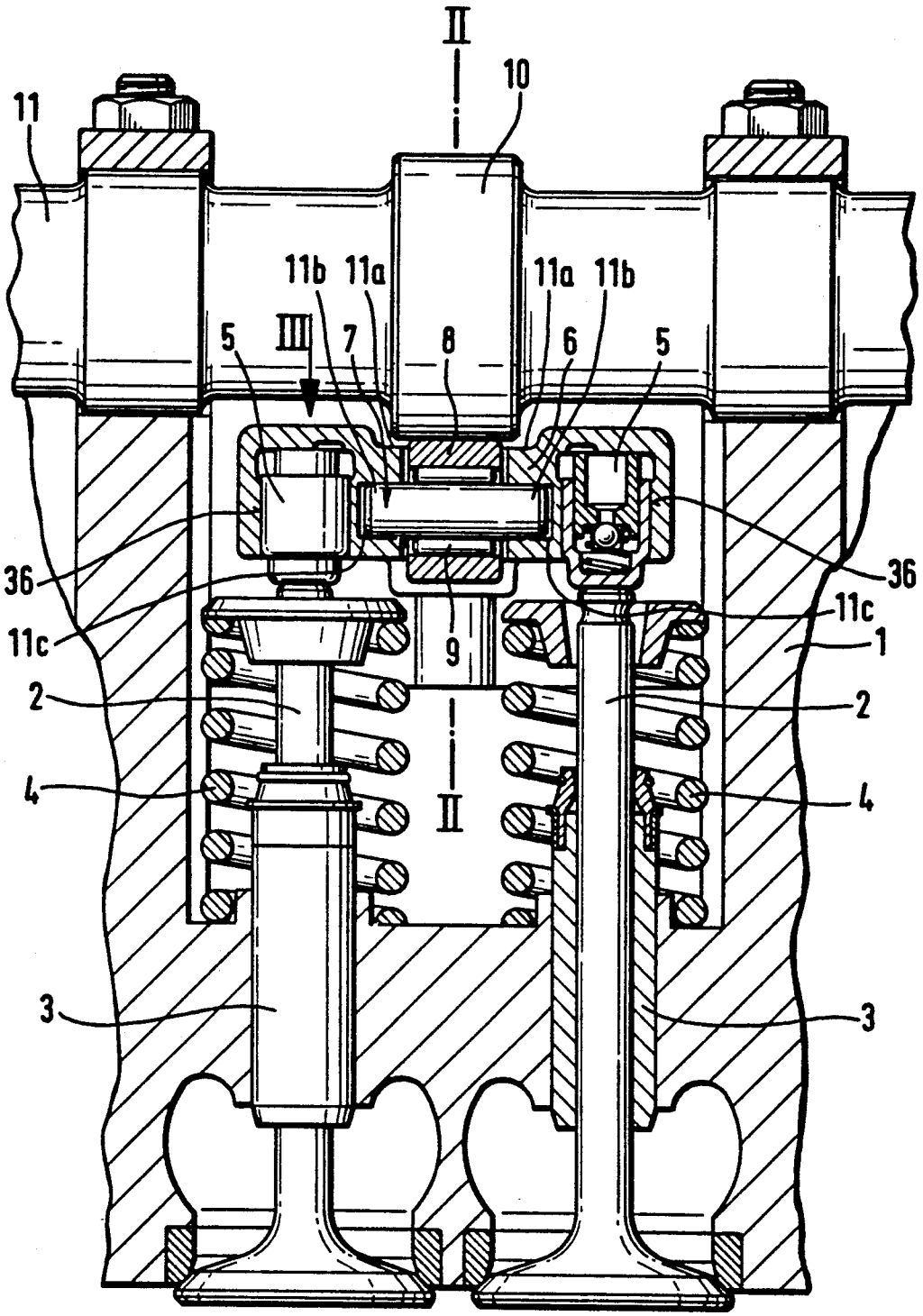

ASSEMBLY FOR SIMULTANEOUSLY ACTUATING TWO VALVES OF AN INTERNAL COMBUSTION ENGINE

The invention concerns an assembly for simultaneously actuating two valves of an internal combustion engine, comprising a beam-shaped bridge which is guided by at least one column, and in whose end regions lash adjusters engaging stem ends of the valves are arranged, the bridge being guided by the column parallelly to longitudinal axes of the valves in the cylinder head, and a rotatably mounted roller adapted to be engaged directly by a control cam being arranged in a central region of the bridge between the two lash adjusters.

Such an assembly is known from FR-A-484,035. This prior-art assembly likewise comprises a beam-shaped bridge for simultaneously actuating two engine valves. A roller projecting beyond the bridge in the direction of the camshaft is arranged at the center of the bridge and is engaged by a control cam. The bridge is guided parallel to the longitudinal axes of the valves by a telescope-type guide made as a hollow cylinder and extending away from the control cam. For valve lash adjustment, in this case, however, only between the roller and the base circle of the control cam, the valve stem ends are provided with a thread. In the bridge, this thread is provided in the region of end clamping jaws. For lash adjustment, these clamping jaws have to be removed in a complicated procedure during a standstill of the engine and the valve stem has to be turned relative to the bridge.

Further disadvantages of this solution are that no automatic valve lash adjustment is achieved, and the structure of the cylinder head for telescopically guiding the bridge is relatively complicated. Moreover, due to the fact that the roller projects beyond the bridge forming a hub-like nose, a relatively large design space is required.

In another assembly of the pre-cited type, known from U.S. Pat. No. 4,924,821, two engine valves are simultaneously actuated by a rocker arm acting via a bridge. A spherical end portion of the rocker arm is received in a cup-shaped lodging in a central portion of the bridge. Hydraulic valve lash adjusting means are arranged in the end regions of the bridge. This type of valve control by a rocker arm is disadvantageous with regard to its rigidity and the number of components involved and, moreover, in this case too, there is a relatively high design space requirement and again, an additional screw is provided for adjusting the rocker arm relative to the bridge. A further disadvantage is that complicated means are required for oil supply to the hydraulic lash adjusters through a longitudinal bore in the rocker arm and said adjusting screw.

It is therefore the object of the invention to provide an assembly for simultaneously actuating two engine valves, which is free of the disadvantages discussed above, and in which, particularly valve lash adjustment is effected automatically and by simple means, with a low design space requirement.

This object is achieved by the invention in accordance with the characterizing features of claim I by the fact that valve lash occurring between the bridge and the stem ends of the valves is adjusted by automatically acting hydraulic lash adjusters, a bore whose lower end opens into an oil channel of the cylinder head being provided in at least one column, and said bore being connected with at least one cross-bore for supplying oil to the lash adjusters. By reason of this construction, no mechanical adjustment of valve lash is required during the entire operating life of the internal combustion engine. The type of oil supply described here can be realized by simple and inexpensive means even in already fabricated cylinder heads, the columns at the same time permitting an exactly parallel guidance of the bridge relative to the axes of the valves. Further, design space requirement as compared to the known State of the Art, is relatively low, and at the same time, the number of moved parts involved is reduced and an adequate rigidity of the valve gear is assured. Advantageously, the bridge of this construction is made of a light-weight material like aluminium, plastic or fiber-reinforced plastic, but it can also be made of solid steel or a composite of sheet steel stampings.

From claim 2 it can be seen that the roller is arranged so as not to project beyond the outer contour of the bridge towards the control cam. This feature has a favourable influence on the overall height of the internal combustion engine.

In a further development of the invention, as can be seen from claim 3, at least one of the columns has a circular cross-section, and at least one of the columns comprises a flattened region which serves to prevent rotation. It is less expensive and simpler from the manufacturing point of view to use materials such as bars for making the columns.

According to claim 4, the bridge is made in one piece with at least one of the columns and engages into bores of the cylinder head. This embodiment is particularly favourable with regard to the number of individual components required.

According to claim 5, the bridge comprises groove-shaped recesses for lodging the end regions of the pin on which the roller is mounted. This embodiment can be fabricated in a simple manner. As stated in claim 6, the pin can be prevented from rotating by a swaging in the bridge. This is a favourable embodiment with regard to material and mounting costs. According to claim 7, the end regions of the pin, which are located in a recess, can be secured by using a closing member of complementary shape to close the recess. In this case, manufacturing costs for the aforementioned swaging can be saved.

Claim 8 provides a fixing of the end regions of the pin in separate mounting elements inserted into the bridge. It is possible to first join the end regions to the mounting elements and then insert them together into the bridge.

Claim 9 describes the guiding of the bridge directly in a recess of the cylinder head. If the cylinder head is designed so as to surround at least a part of the outer peripheral surface of the bridge, and has a complementary shape, separate columns for guiding the bridge can be dispensed with.

Figure 2:
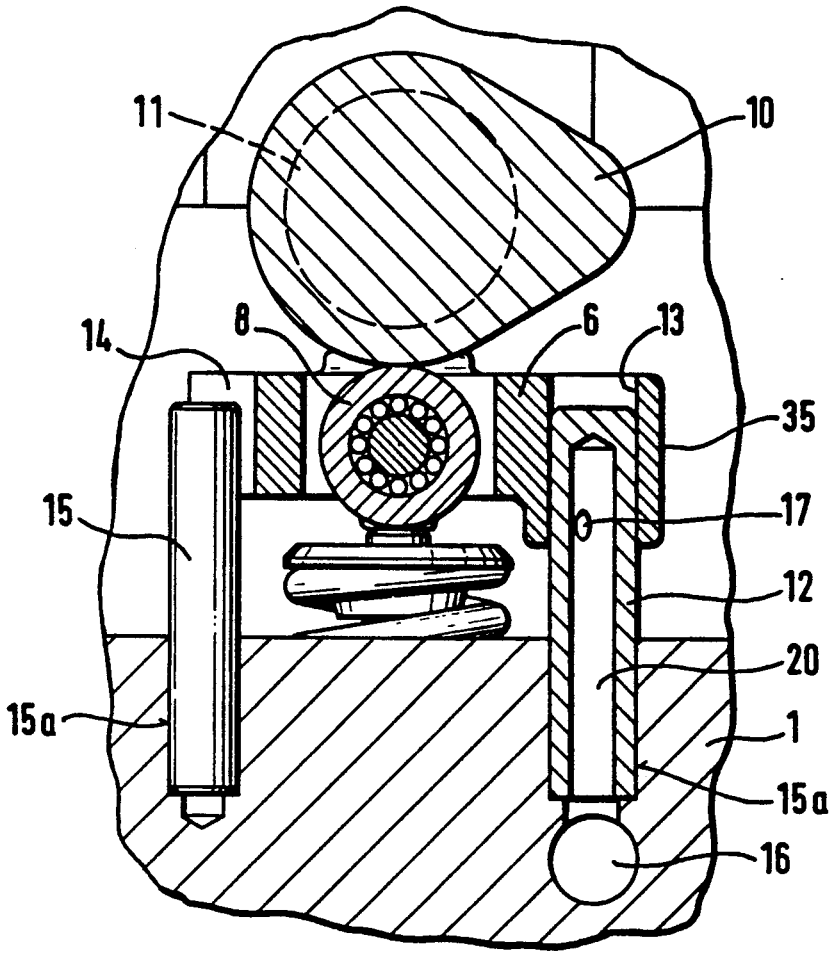
Figure 3:
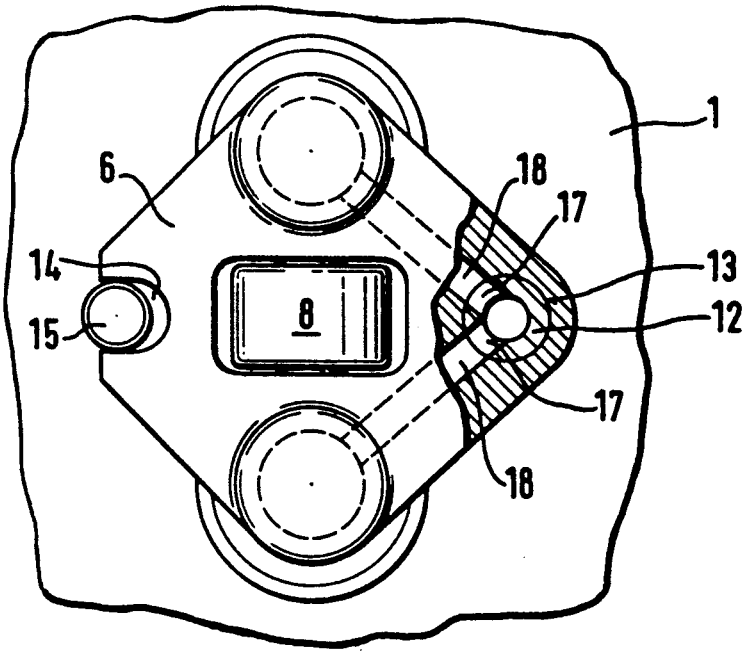
Figure 4:
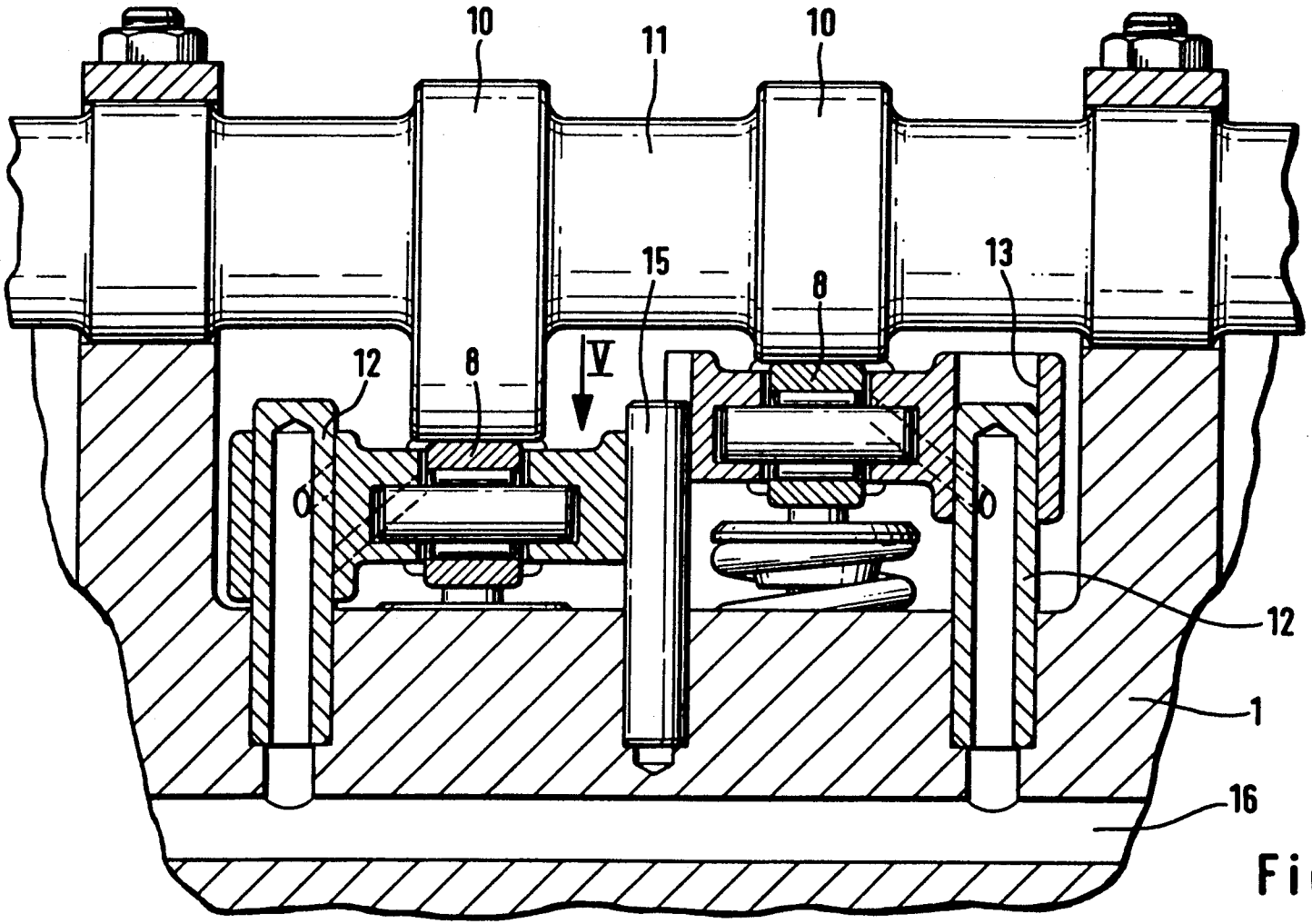
Figure 5:
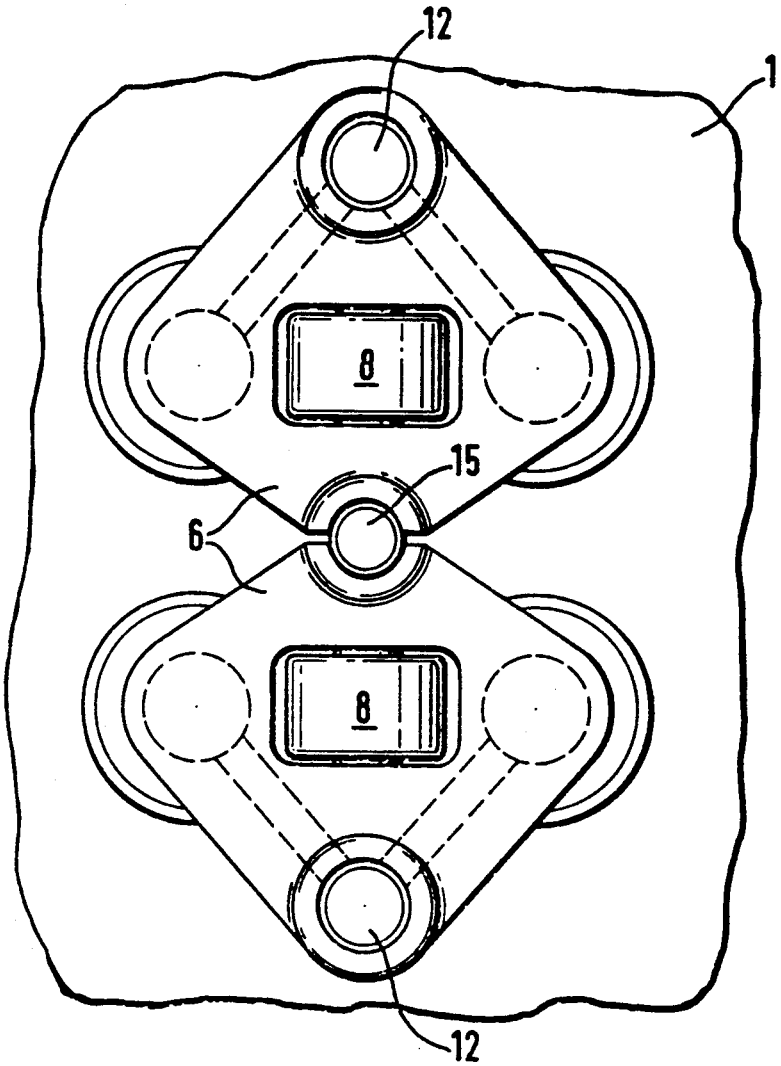
Figure 6:
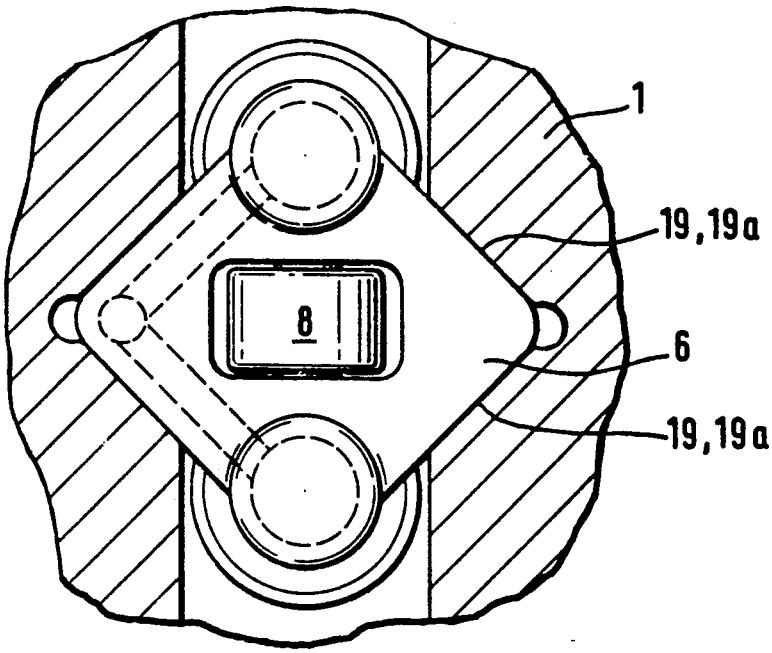
Figure 7:
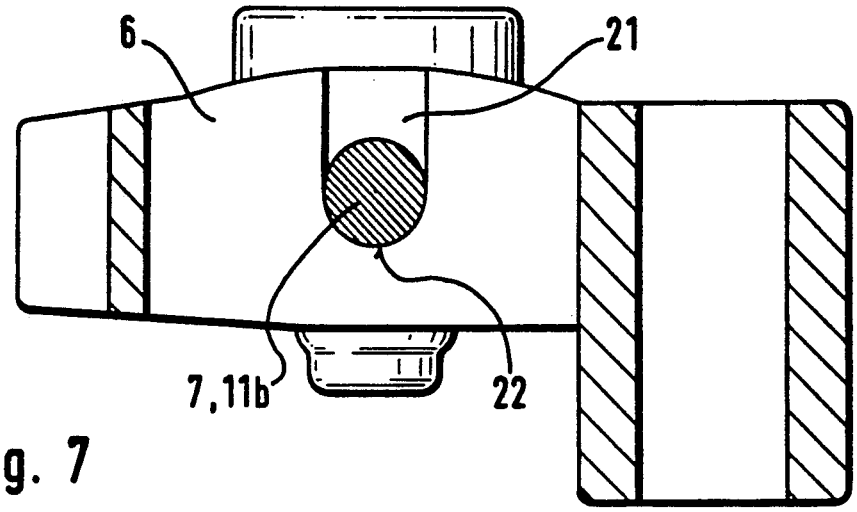
Figure 8:
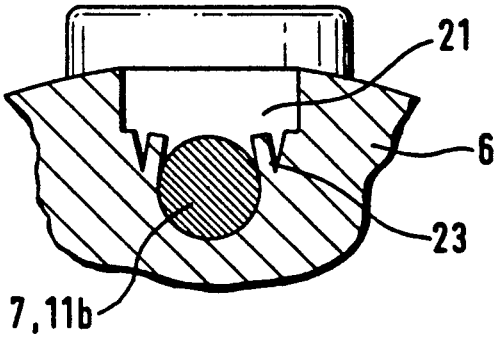
Figure 9:
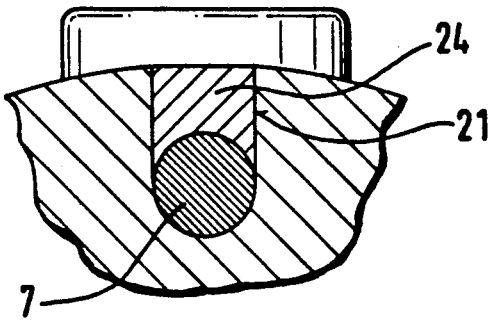
Figure 10:
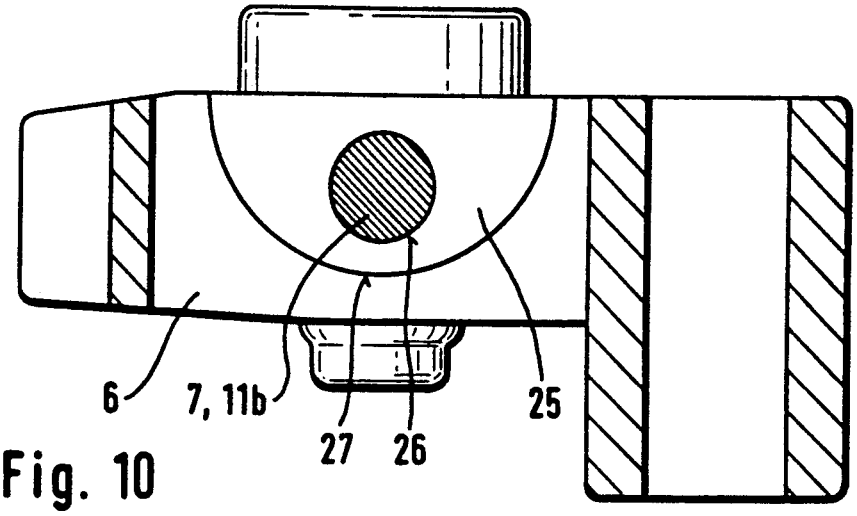
Figure 13:
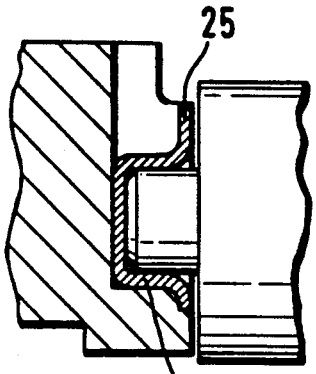
Figure 14:
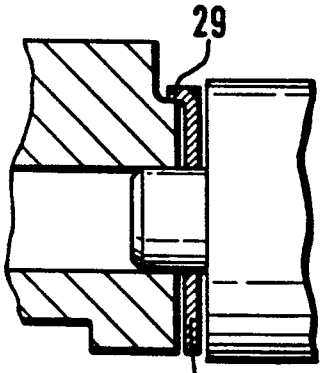
Figure 15:
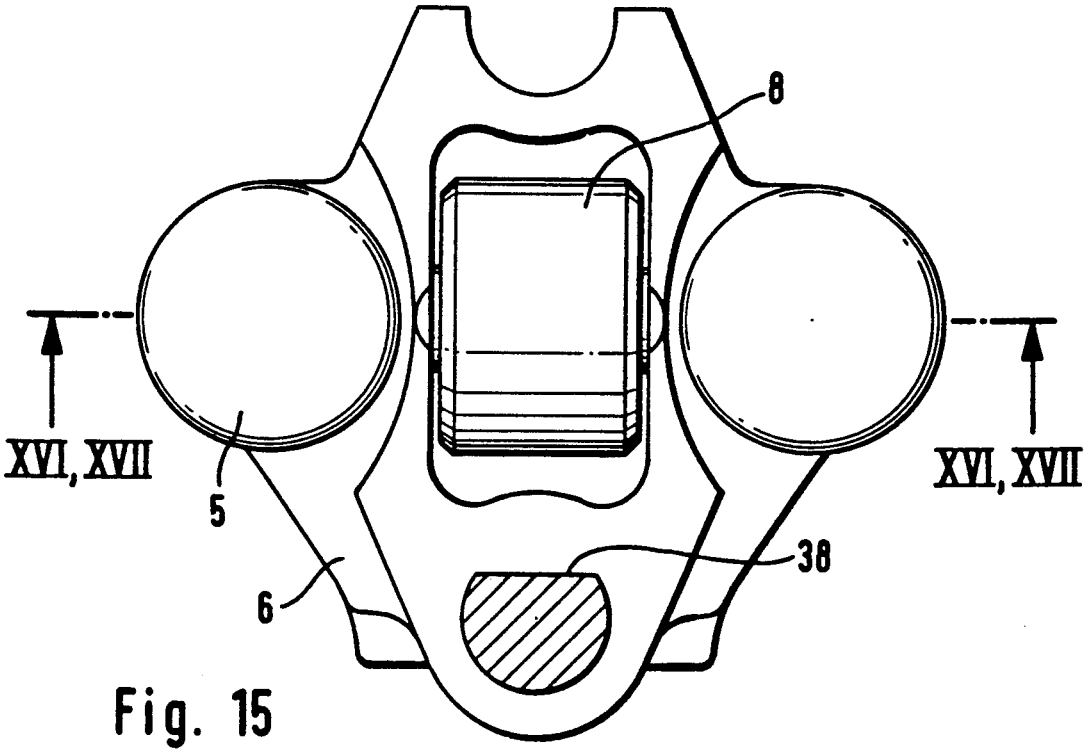
Figure 16:
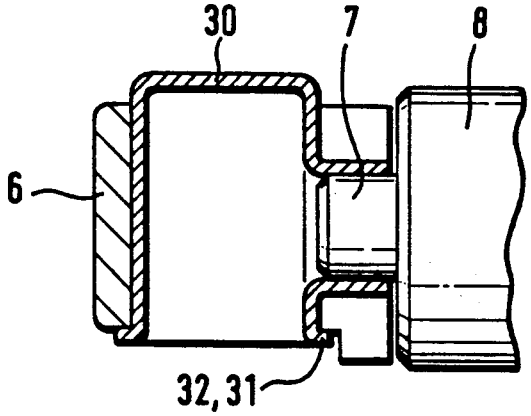
Figure 17:
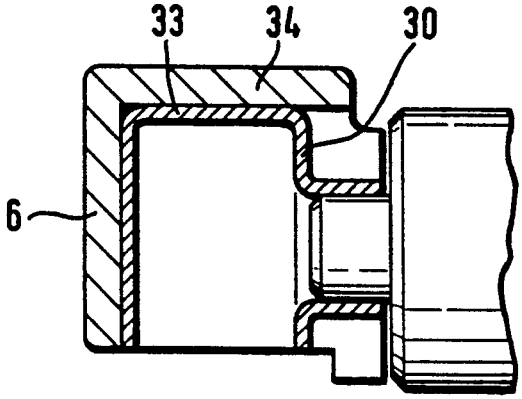
Figure 18:
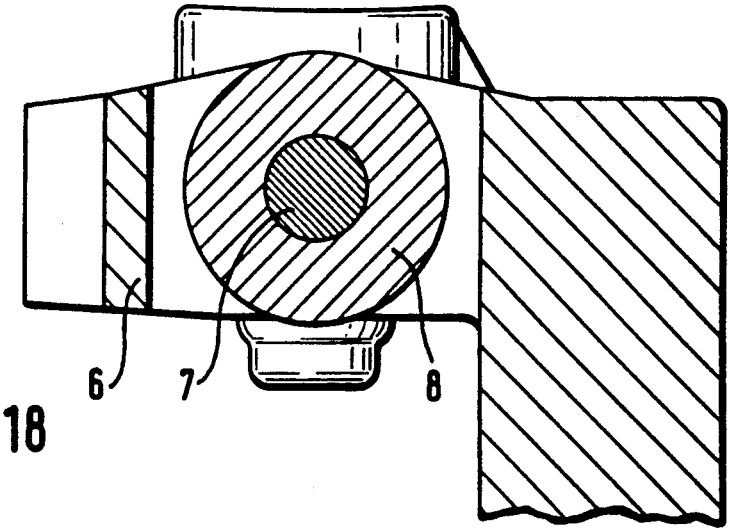
Figure 19:
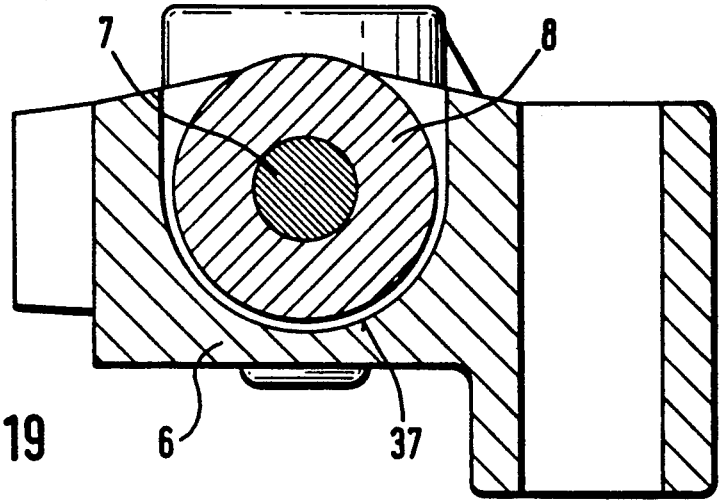
Figure 20:
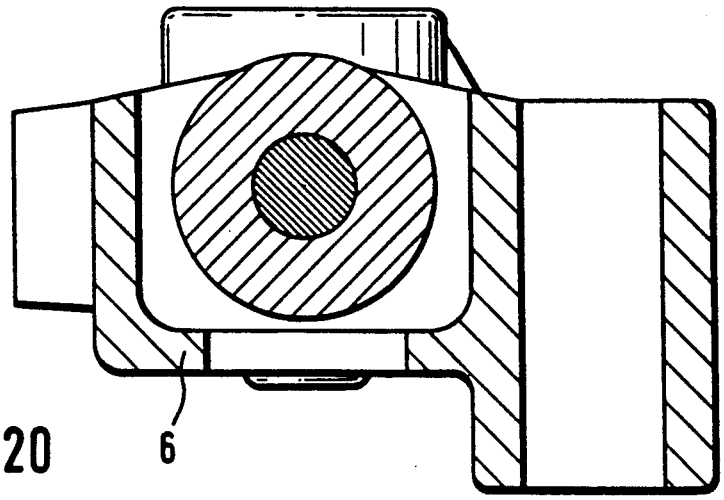

Examples of embodiment of the invention are represented in the drawings which show:

FIG. 1, a longitudinal section through an assembly in accordance with the invention, FIG. 2, a section taken along line II—II of FIG. 1, FIG. 3, a top view in the direction of the arrow III of FIG. 1, FIG. 4, a section through two assemblies according to the invention, arranged next to each other, FIG. 5, a top view in the direction of the arrow V of FIG. 4, FIG. 6, a top view of a modified guiding arrangement for the bridge, FIG. 7, a cross-section through the bridge showing a method of mounting the pin, FIG. 8, the cross-section of FIG. 7 showing a second method of mounting the pin, FIG. 9, the cross-section of FIG. 7 showing a further method of mounting the pin, FIG. 10, the cross-section of FIG. 7 showing a method of mounting the pin in a separate retaining member, FIGS. 11–14, an enlarged longitudinal section of the bridge showing different embodiments of the retaining member, FIG. 15, a top view of the bridge 6, FIGS. 16–17, a partial section along line XVI,XVII—XVI,XVII of FIG. 15 showing methods of guiding the lash adjuster in the bridge, and FIGS. 18–20, further cross-sections through the bridge.

FIG. 1 is a representation in longitudinal section of an assembly in which two adjacent valves 2 slidably mounted in a known manner in valve guides 3 are retained by valve springs 4 in a closed position in a cylinder head 1. These two valves 2 are actuated simultaneously by the fact that, for example, hydraulic lash adjusters 5 arranged longitudinally displaceable in opposite ends of a beam-shaped bridge 6 bear against the stem ends of the valves. In FIG. 1, the right-hand lash adjuster is shown in a sectional view. Since the internal structure of these lash adjusters, known in themselves, is not pertinent to the invention, a detailed description is not necessary here. In the central region of the bridge 6, a roller 8 is rotatably mounted on rolling elements 9 surrounding a pin 7, the roller 8 being adapted to be engaged by a control cam 10 of a camshaft 11 mounted in a known manner on the cylinder head.

During the phase in which the valves are closed and the base circle of the control cam 10 runs on the roller 8, any existing lash is adjusted by the hydraulic lash adjusters. When the nose of the control cam 10 runs against the roller 8, the bridge 6 is moved uniformly downwards and thereby opens the two valves 2 to the same extent. This is only possible if the bridge 6 is guided exactly parallel to the axes of the valves 2.

As can likewise be seen in FIG. 1, the outer surface 11*a* of the bridge, 6 surrounding the roller 8 and facing the control cam 10 is trough-shaped. This configuration serves as an oil reservoir for better lubrication of the roller 8 and the pin 7 as well as the rolling elements 9. The two axial end regions 11*b* of the pin 7 are fixed in lodgings 11*c* provided in the bridge 6. Other methods of fixing will be seen from the description of the figures given below. The lodging 11*c* can also be constituted by separately swaged-in retaining segments, not described more closely here. A few methods of mounting the pin 7 for the roller 8 are shown in FIGS. 7 to 9.

The guiding of the bridge 6 by two columns is shown in FIGS. 2 and 3. The column 12, which is made as a hollow column closed at one end, is fixed by its lower end in the cylinder head I and engages in a longitudinal through-bore 13 of the bridge 6. At the opposite end of the bridge 6, a longitudinal recess 14 is provided into which a second column 15 engages, the lower end of which column is likewise fixed to the cylinder head 1. A perfectly parallel guidance of the bridge 6 is guaranteed by these two columns 12 and 15. In an advantageous manner, the columns 12 and 15 can be fixed to an adjacent component by pressing-in or by a screwing thread.

In another embodiment, the columns 12 and 15 are fixed in the bridge 6 and guided in bores 15*a* of the cylinder head 1. Combinations of the heretofore described guiding arrangements for the bridge 6 are also conceivable.

The hollow column 12 serves at the same time for supplying oil from the engine oil circuit to the hydraulic lash adjusters 5. For this purpose, an oil channel 16 transfering oil from the engine opens into the lower end of the column 12. The oil mounts through the bore 20 of the column 12 and reaches the hydraulic lash adjusters 5 through cross-bores 17 and distributing bores 18 in the bridge 6.

FIGS. 4 and 5 show an embodiment in which two adjacent bridges are guided in a manner similar to the one shown in the preceding figures. However, in this embodiment, only a single column 15 is required for guiding the two bridges 6. For the rest, the guiding arrangement is identical with that of FIGS. 2 and 3 so that no special description is required here. However, the arrangement of the hydraulic lash adjusters, and therefore also the arrangement of the valves with regard to the camshaft differs from the previously described arrangement. While in the embodiment of Figs. I to 3, an imaginary line joining the two simultaneously actuated valves 2 is parallel to the camshaft 11, in the embodiment of FIGS. 4 and 5, this imaginary line is at a right-angle to the axis of the camshaft 11. This arrangement has the advantage that the intake and exhaust valves of a cylinder of an internal combustion engine can be actuated by one and the same camshaft.

FIG. 6 shows a top view of a bridge 6 comprising opposing prism surfaces 19 inclined at a right-angle to each other and cooperating with corresponding counter-surfaces of the cylinder head I to assure a precise guidance of the bridge 6.

According to FIG. 7, the end regions 11*b* of the pin 7 are received in 3 groove-shaped recess 21 in the bridge 6, the groove base 22 being of a semicircular shape. It is appropriate to dimension the width of the groove-shaped recess to correspond approximately to the diameter of the pin. This width can, however, also be slightly smaller to permit a pressed connection.

FIG. 8 shows a lodging for the end regions 11*b* of the pin 7 similar to that of FIG. 7. However, in this case the pin 7 is positioned and secured against rotation by a swaging 23 in the bridge 6.

FIG. 9 shows another method of mounting the pin 7 corresponding to that of FIG. 7. The pin 7, however, is secured in the recess 21 by a member 24.

Further, as can be seen in FIG. 10, the end regions 11*b* of the pin 7 can also be mounted in a separate retaining member inserted into the bridge 6. Here, this retaining member is made as a semicircular mounting element 25 comprising a bore 26 for receiving the end regions 11*b*. The mounting element 25 is supported in a pocket 27 of complementary shape provided in the bridge 6. This mounting element 25 can also be box-shaped or of any other geometric shape.

Figure 11:
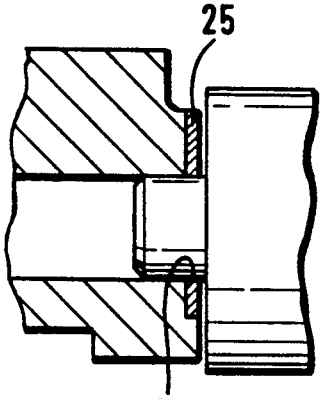

As can be seen in FIG. 11, the bore 26 is arranged eccentrically in the disc 25. This can be necessary for optimally integrating the roller 8 in the design clearance available for it in the bridge 6.

Figure 12:
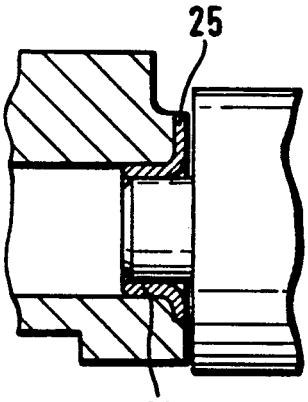

FIGS. 12 and 13 show different embodiments of the mounting element 25. In an advantageous manner, this mounting element can comprise a sleeve-shaped portion 28. This portion 28 forms a slide bearing for the pin 7. When in the course of the operating life of the assembly of the invention, the portion 28 gets worn, it can be replaced simply by a new portion 28.

FIG. 14 shows an advantageous development of the mounting element 25 of FIGS. 11 to 13. With a view to axial positioning, the mounting element 25 can comprise a turned-over end region 29. During assembly, this end region 29 forms an exact stop for the mounting element 25.

As can be seen in FIGS. 15 to 17, the guide of the lash adjuster 5 can at the same time be configured as a, preferably, pressed-in receiving bush 30 for mounting the pin 7. The open, annular region 31 of the receiving bush 30 facing away from the control cam 10, not shown here, comprises a turned-over positioning edge 32 which is supported on the bridge 6. FIG. 17 shows a receiving bush 30 according to FIG. 16, however, here, the receiving bush 30 is supported by its closed axial end region 33 on a closed portion 34 of the bridge 6. By reason of these possibilities of configuring the receiving bush 30 in the manner shown in FIGS. 15 to 17, the longitudinal bore 13 which receives the lash adjuster 5 needs no special fine finishing during fabrication. The receiving bush 30 can compensate any surface roughness and manufacturing tolerances to a certain extent.

FIGS. 18 to 20 show design variants of the bridge 6 in the region of the roller 8 facing the control cam 10. A simple solution is shown in FIG. 18 in which the roller 8 is naked in the region of the bridge 6. If, for example, during assembly a support surface is required for the roller 8, the bridge 6 can be made semicircular or, as shown in FIG. 20, rectangular in shape in the region of the roller 8.

I claim:

1. Assembly for simultaneously actuating two valves (2) of an internal combustion engine, comprising a beam-shaped bridge (6) which is guided by at least one column (12 or 15), and in whose end regions lash adjusters (5) engaging stem ends of the valves are arranged, the bridge (6) being guided by at least one of the columns (12 or 15) parallelly to longitudinal axes of the valves (2) in the cylinder head (1), and a rotatably mounted roller (8) adapted to be engaged directly by a control cam (10) being arranged in a central region of the bridge (6) between the two lash adjusters (5), characterized in that valve lash occurring between the bridge (6) and the stem ends of the valves (2) is adjusted by automatically acting hydraulic lash adjusters (5), a bore (20) whose lower end opens into an oil channel (16) of the cylinder head (1) being provided in at least one column (12 or 15), and said bore (20) being connected with at least one cross-bore (17) for supplying oil to the lash adjusters (5).

2. Assembly according to claim 1, characterized in that the roller (8) is arranged so as not to project beyond an outer contour of the bridge (6) towards the control cam (10).

3. Assembly according to claim 1, characterized in that at least one of the columns (12 or 15) has a circular cross-section, and at least one of the columns (12 or 15) comprises a flattened region (38) which serves to prevent rotation.

4. Assembly according to claim 1, characterized in that the bridge (6) is made in one piece with at least one of the columns (12 or 15) and engages into bores (15*a*) of the cylinder head (1).

5. Assembly according to claim 1, characterized in that the bridge (6) comprises groove-shaped recesses (21) for lodging end regions (11*b*) of a pin (7) on which the roller (8) is mounted.

6. Assembly according to claim 5, characterized in that at least one of a positioning and prevention of rotation of the end regions (11*b*) of the pin (7) is achieved by at least one swaging (23) in the bridge (6) in the region of the recess (21).

7. Assembly according to claim 5, characterized in that at least one of a positioning and prevention of rotation of the end regions (11*b*) of the pin (7) is achieved by closing the recess (21) by at least one closing member (24) complementary in shape to the recess (21).

8. Assembly according to claim 1, characterized in that end regions (11*b*) of a pin (7) on which the roller is mounted are lodged in separate mounting elements (25) which are fixed in the bridge (6).

9. Assembly according to claim 1, characterized in that the bridge (6) comprises mutually inclined prism surfaces (19) each of which cooperates with a corresponding counter-surface (19*a*) of the cylinder head (1).

* * * * *